United States Patent [19]

Kurz

[11] Patent Number: 4,937,912

[45] Date of Patent: Jul. 3, 1990

[54] MOUNTING DEVICE FOR SENSORS AND PICK-UPS

[75] Inventor: Gerhard Kurz, Stuttgart, Fed. Rep. of Germany

[73] Assignee: Interlava AG, Lugano, Switzerland

[21] Appl. No.: 302,950

[22] Filed: Jan. 30, 1989

[30] Foreign Application Priority Data

Feb. 9, 1988 [DE] Fed. Rep. of Germany ..... 3803824

[51] Int. Cl.[5] ..... A47L 5/12

[52] U.S. Cl. ..... 15/339; 55/274

[58] Field of Search ..... 15/339, 319; 55/274; 73/861.41

[56] References Cited

U.S. PATENT DOCUMENTS

| | | | |
|---|---|---|---|
| 3,333,564 | 8/1967 | Waters | 15/339 X |
| 3,440,681 | 4/1969 | Hixson et al. | 15/339 |
| 3,452,385 | 7/1969 | Fleck et al. | 15/339 |
| 3,875,891 | 4/1975 | Zeldman | 55/274 X |
| 3,989,311 | 11/1976 | DeBrey | 15/339 X |
| 4,195,383 | 4/1980 | Leinfelt | 15/339 |
| 4,767,213 | 8/1988 | Hummel | 15/339 X |

FOREIGN PATENT DOCUMENTS

| | | | |
|---|---|---|---|
| 3431164 | 8/1985 | Fed. Rep. of Germany | 15/339 |
| 1395301 | 5/1975 | United Kingdom | 15/339 |

*Primary Examiner*—Frankie L. Stinson

*Attorney, Agent, or Firm*—Darby & Darby

[57] ABSTRACT

In connection with a mounting device for sensors and pick-ups generally, serving as dust-detecting means for vacuum cleaners, in particular in the form of luminous diodes and phototransistors arranged adjacent the suction channel of the said vacuum cleaner, it is proposed to form at least one axial channel, leading from the inside to the outside, immediately adjacent the sensor, through which an air flow is passed due to underpressures or overpressures prevailing in the area of the sensor, which air flow acts to continuously clean the sensitive area of the sensor.

4 Claims, 1 Drawing Sheet

MOUNTING DEVICE FOR SENSORS AND PICK-UPS

BACKGROUND OF THE INVENTION

The present invention relates to a mounting device for sensors and pick-ups according to the preamble of claim 1.

Without the comprehensive application of sensors and pick-ups it would be impossible to solve the problems of modern technology. In the broader sense, sensors are virtually the eyes and ears of any electric control device, basically even of any automatic technical operation.

Frequently, however, problems are encountered in connection with such technical sensors, for example optical systems such as light barriers, inductive or capacitive pick-ups, ultrasonic sensors and their correcting receivers, and the like, because their sensitive zones get increasingly contaminated by dirt or covered up by undesirable layers, for example when sensors are installed in, or even intended to observe, a dirty environment.

The preferred embodiment of the invention relates to a mounting device for optical dust detecting means, for example in the form of a luminous diode/phototransistor combination used in a vacuum cleaner. This application will, therefore, be regarded hereafter in greater detail, although it is understood that the invention is by no means restricted to it.

It has been known in connection with vacuum cleaners, for example, to arrange at least one light transmitter and a coacting light receiver adjacent the channel which is passed by the dirt and dust particles drawn in, so that the detected dirt level is indicated, or the power of the electric motor driving the blower is changed over, in response to the quantity of dirt and dust particles (still) flowing through the suction channel which is then compared with a given threshold value (DE-OS No. 34 31 164). It has been further known in this connection to arrange the optical dust detecting means in a separate housing which is either fixed on the suction channel of the vacuum cleaner or mounted between the suction nozzle and the suction pipe and which is switched on as required by a separate minimum pressure governor responding to a given minimum pressure in the suction pipe (published European Patent Application No. 0 231 419).

All these sensors are, however, connected with the problem that the effectiveness of their sensitive zones may get impaired or even fully lost because these areas get clogged, i.e. covered up, fully or in part, by dust settling from the environment or, especially in the case of vacuum cleaners, by dusts or the like, flowing past such areas.

Due to the fact that it is difficult or practically impossible to produce optical dust detecting means projecting into a suction channel with absolutely smooth surfaces and/or inner faces, since at least the sensitive area of the respective sensor or optical sensor or receiver must project through, or be arranged flush with, the wall of the channel, there is always the risk that dust particles or lint may be caught in the transition area, retain and collect other dusts and solid particles and, finally, gradually cover up the sensitive area. The same may happen in the case of light barriers or ultrasonic pick-ups installed in machines or other systems when they are exposed to the risk of contaminations settling gradually on their sensitive areas from the surrounding air.

While manual cleaning of the sensor surfaces is not excluded, it is not always possible in practice. Applied to vacuum cleaners, this may be the case, for example, when the optical dust detecting means are arranged on either side of a long narrow channel, i.e. at a location which is not, or not readily, accessible by the fingers or some device. In addition, it is not to be expected that such a cleaning procedure will be actually performed in all cases.

Now, it is the object of the present invention to provide a mounting device for sensors of any type, and especially for optical dust detecting means of a vacuum cleaner, which is designed in such a manner that cleaning is effected automatically.

ADVANTAGES OF THE INVENTION

The mounting device according to the invention solves this problem with the aid of the characterizing features of the main claim and provides the advantage that the sensitive area is automatically cleaned and blown off using overpressures or underpressures of the surrounding air prevailing at the location of the device, and this without regard to the design of the sensitive area of the sensor, i.e. also in cases where this area is not arranged absolutely flush with the adjacent wall. The invention, therefore, makes use of the pressure differences prevailing at any time for guiding air volumes or air flows through longitudinal channels provided in the area of the location of the sensors and adjacent thereto, and for passing them over and along the sensor in such a manner that its sensitive area is kept clean and/or blown free, during normal operation of the system, through air blown upon or at least passing by such areas.

The features specified in the sub-claims permit advantageous further developments and improvements of the mounting device specified by the main claim. A particularly advantageous solution is obtained when the mounting device is formed integrally with the surrounding pipe wall. In this case, the mounting means may, for example, form a cylindrical projection accommodating in its inner bore the—for example—cylindrical rotational-symmetrical sensor, while at the same time longitudinal channels are provided around the sensor, for example by leaving spaces in certain peripheral areas, which in the case of the suction channel of a vacuum cleaner open from the inside of the pipe towards the outside of the pipe so that due to the underpressure generated by the vacuum cleaner in the suction pipe an air flow will be generated in these longitudinal channels which—although in the case of a vacuum cleaner it has to be regarded as undesirable infiltrated air—is too small to be disturbing while, on the other hand, the cleaning effect achieved by it is particularly important for the sensors and their sensitive areas which are wiped by these air flows.

BRIEF DESCRIPTION OF THE DRAWING

One embodiment of the invention will be described hereafter with reference to the drawing in which.

DESCRIPTION OF THE EMBODIMENTS

It is the basic idea of the present invention that overpressures or underpressures prevailing in the area of installation of the sensors may be utilized, or generated, and that longitudinal channels, especially such permitting to cover also the sensitive areas of the sensors, may be formed for guiding air flows along the sensors and over their sensitive areas in such a manner that a continuous cleaning effect is achieved.

Figure 1:
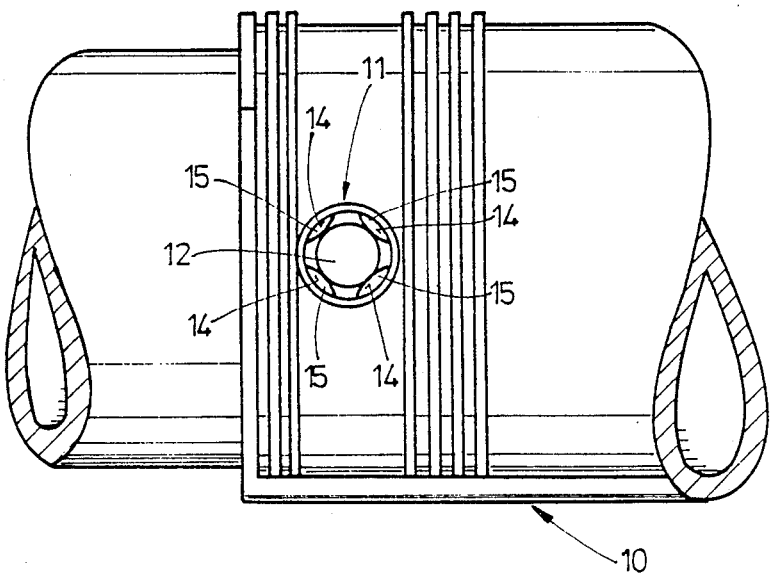
FIG. 1 shows a stepped wall section, especially for the suction pipe of a vacuum cleaner, comprising in this example a sensor—shown in plan view —located in the wall of the pipe; the sensor as such may be of any kind.

The particular example described for the purposes of the present invention relates to optical dust detecting means comprising a luminous diode and a phototransistor arranged in the suction pipe of the vacuum cleaner. Part of the stepped suction pipe is designated by 10 in FIG. 1. The location of the sensor or sensors is designated by 11 or 11*a*, 11*b*.

The structure and function of these optical dust detecting means have been described in greater detail by the before-mentioned publications, namely DE-OS No. 34 31 164 and the before-mentioned published European Patent Application, so that they need not be described here once more in detail.

Figure 2:
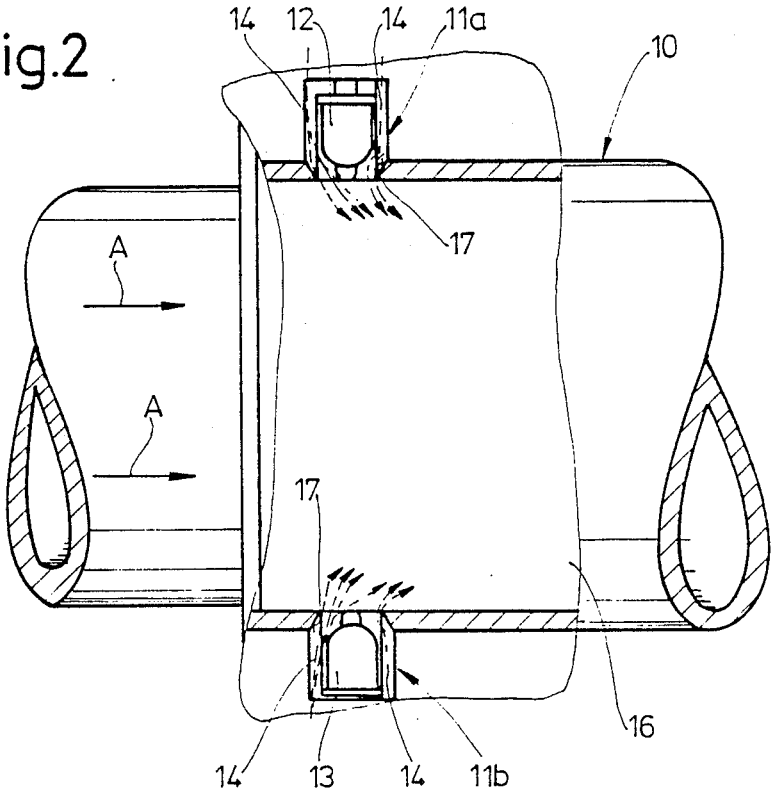
FIG. 2 shows the same representation as FIG. 1, but in cross-section, it being obvious from this illustration that the sensors are arranged opposite each other in the way of a light barrier.

As can be seen in FIG. 2, a portion of the suction channel—which may of course also be an inner pipe of a separately fitted housing equipped with optical dust detecting means—comprises for example a light transmitter 12 in the form of a luminous diode and, arranged opposite thereof, a light receiver 13 in the form of a phototransistor. The two units are mounted in such a manner that their sensitive areas face each other which means that the phototransistor receives the radiation emanating from the light transmitter, always interrupted by dusts and dirt particles carried in the direction of flow indicated by arrows A, whereby a dust-detecting signal can be generated and evaluated using suitable subsequent evaluation circuits.

In order to prevent the risk that the sensors generally, in the present case a luminous diode and the phototransistor—whose sensitive areas are not always mounted flush, but may have any desired shape, as can be seen very clearly in FIG. 2—may get progressively covered up by dirt particles and dusts which although they may collect at any point of the suction channel will get caught preferably in these areas where edges, steps, projecting parts, or the like, are encountered, the mounting device for the sensor is designed in such a manner that at least one longitudinal channel 14 is provided which forms an open connection from the outside to the inside. In the embodiment illustrated in FIG. 1, four such longitudinal channels 14 are distributed evenly over the periphery, between the inner wall of the mounting device—which exhibits a circular cross-section in the example shown—and the adjacent outer wall of the sensor which is inserted or received in the mounting device and may be retained in the bore of the mounting device only by its flush contact with the wall of the bore (or may be additionally fixed by gluing or the like).

In the embodiments shown in the drawings, the mounting device consists preferably of an integrally formed projection and/or cylindrical extension projecting from the pipe wall of the suction channel and provided with an inner opening for receiving the sensor, i.e. in the present case the luminous diode or the phototransistor. Due to the longitudinal channels 14, spaced axial wall portions 15 are in direct contact with the outer wall of the sensor, it being understood that the particular design or shape of the (remaining) wall portions left between the axial channels 14, which may also have any desired shape, may be formed at desire. It will be seen that on the hand the sensor, which in the present case has a cylindrical oblong design, is firmly retained in the receiving opening of the mounting device, while on the other hand continuous channels are formed for guiding air flows—indicated by the broken lines in FIG. 2—from the outside to the inside, at a considerable velocity, due to the underpressure prevailing in the interior 16 of the suction channel of the vacuum cleaner.

These air flows blow the area of the sensors efficiently clean of all possible collections of dust or solid particles; they keep the sensitive areas clear of any dust particles and ensure in this manner the perfect function of the sensors over extended periods of time.

According to an advantageous further improvement of the present invention, it is provided that when tapering sensor surfaces are used or when the sensitive sensor areas extend substantially flush with the surface of the inner pipe wall, the axial channels 14 are provided with inclined inner portions 17, at the point where they open into the free interior of the suction channel adjacent the sensitive areas of the sensors. As indicated by the dashed lines of the arrows, such inclined portions serve to center the air flows, i.e. to direct them upon the central area of the sensor (sensitive area), thereby supporting the cleaning effect. One may describe these inclined portions also as baffle surfaces serving to deflect the air flows generated by the underpressure and to direct them upon the sensitive area of the dust detecting means.

All features mentioned or shown in the above description, the following claims and the drawing may be essential to the invention either alone or in any combination thereof.

I claim:

1. Mounting device for sensors and pick-ups of vacuum cleaners which are arranged, as dust-detecting means, adjacent a suction channel passed by the dust and dirt particles, and whose sensitive areas are exposed, at their point of installation, to contamination or to being covered up, in particular optical or electric dust-detecting means, characterized in that at least one channel (14) is arranged in the mounting area (11) of the sensor, directly adjacent the body of the sensor (12, 13) and its sensitive area, through which an air flow is guided due to the underpressures and overpressures produced by the vacuum blower itself, Whereby the sensitive area is continuously cleaned.

2. Mounting device according to claim 1, characterized in that the at least one channel (14) is axially guided, relative to the longitudinal axis of the sensor, in such a manner that the blowing effect of the air flow reaches the sensitive area of the sensor.

3. Mounting device according to claim 2, characterized in that the at least one channel (14) is provided with an inclined portion (17) at the level of the sensitive area which portion serves as a baffle surface for the air flow guided through the channel, so that the air flow is deflected towards the sensitive area of the sensor.

4. Mounting device according to claim 1, characterized in that for receiving the (optical) sensor used as dust detecting means in vacuum cleaners, the suction channel is designed as an integrally formed outwardly projecting holder of generally cylindrical shape, with inner wall portions (15) projecting inwardly over the length of the holder, in peripherally spaced arrangement, for retaining the luminous diode or the phototransistor, and forming between them a plurality of axial channels (14) through which the cleaning air flow is passed due to the underpressure prevailing in the suction pipe.

* * * * *